US007478617B2

(12) United States Patent
Wang

(10) Patent No.: US 7,478,617 B2
(45) Date of Patent: Jan. 20, 2009

(54) HAND-FREE STARTER FOR POWER GENERATOR

(76) Inventor: Li Wang, 1733 Piermont Dr., Hacienda Heights, CA (US) 91745

( * ) Notice: Subject to any disclaimer, the term of this patent is extended or adjusted under 35 U.S.C. 154(b) by 58 days.

(21) Appl. No.: 11/541,622

(22) Filed: Sep. 28, 2006

(65) Prior Publication Data

US 2008/0078350 A1 Apr. 3, 2008

(51) Int. Cl.
*F02N 3/04* (2006.01)

(52) U.S. Cl. ..... 123/185.4; 74/6

(58) Field of Classification Search ... 123/185.1–185.4; 74/6

See application file for complete search history.

(56) References Cited

U.S. PATENT DOCUMENTS 5,174,166 A * 12/1992 Tryon et al. ..... 74/6
5,630,388 A * 5/1997 Eaton ..... 123/185.4
6,489,690 B1 * 12/2002 Hatsugai et al. ..... 290/1 A

* cited by examiner

*Primary Examiner*—Stephen K Cronin
*Assistant Examiner*—Ka Chun Leung
(74) *Attorney, Agent, or Firm*—Raymond Y. Chan; David and Raymond Patent Firm

(57) ABSTRACT

A power generator includes a supporting frame, a generator supported by the supporting frame, and an engine mechanism including an engine driving the generator and a recoil starter for starting the engine via starter cable. The power generator further includes a hand-free starter arrangement which includes a foot pedal movably supported by the supporting frame and a transmission unit coupling a pulling end of the starter cable with the foot pedal to transmit the downward stepping force of the foot pedal to a pulling force of the starter cable. A downward displacement of the foot pedal is corresponding to an operation length of the starter cable to start the engine such that when the foot pedal is depressed, the starter cable is pulled with the operation length to start the engine in a hand-free manner.

3 Claims, 5 Drawing Sheets

HAND-FREE STARTER FOR POWER GENERATOR

BACKGROUND OF THE PRESENT INVENTION

1. Field of Invention

The present invention relates to a power generator, and more particularly to a hand-free starter for a power generator, which is adapted for starting the engine to drive the generator via a recoil starter in a hand-free manner.

2. Description of Related Arts

A conventional power generator, especially for a portable power generator, comprises an engine and a generator driven by the engine, wherein the engine generally comprises a recoil starter to start the engine. The recoil starter generally has a cable opening formed at the engine and comprises a starter cable having a pulling end extending out of the engine through the cable opening and a hand bar attached to the pulling end of the starter cable. Accordingly, the starter cable has an operation length adapted to be pulled via the hand bar to generate an initial momentum to start the engine. However, such power generator has several drawbacks.

As it is mentioned above, the user must apply a pulling force by hand to pull the starter cable for starting the engine. Although the power generator is convenient and useful, the user always has problem to apply enough pulling force to start the engine. For the small engine, such as less than 10 horsepower, the user must apply 20 to 40 pound force for each pulling action. In other words, if the user pulls the starter cable four times, he or she will totally take 80 to 160 pound force to start the engine. In fact, the user will be tried after several trails of pulling the starter cable. However, the engine requires the certain initial momentum to be started such that it is getting harder and harder for the user to start the engine after the user has pulled the starter cable for several times.

The engine of the power generator must be started by hand. The design of such recoil starter is particularly fit for the user having a powerful arm. It means that if the arm of the user is weak or injury, the user is unable to start the engine. In addition, the recoil starter is mainly designed for the right-hand user, the left-hand user may not have enough power to pull the starter cable to start the engine.

Furthermore, since the power generator is designed for enhancing the portability. The size of the power generator should be small. Therefore, the user must bend down his/her body to reach the hand bar and to pull the starter cable. In other words, the user may hurt his/her body and/or arm during the pulling action when his/her body is at the bending down position.

SUMMARY OF THE PRESENT INVENTION

A main object of the present invention is to provide a power generator which comprises a hand-free starter for starting the engine to drive the generator via a recoil starter in a hand-free manner.

Another object of the present invention is to provide a power generator with a hand-free starter, which comprises a transmission unit to transmit a downward stepping force of a foot pedal to a pulling force of a starter cable, such that the user is able to use his/her foot to step on the foot pedal to start the engine. In other words, the foot of the user is more powerful than the arm of the user to ensure the power generator to be activated.

Another object of the present invention is to provide a power generator with a hand-free starter, wherein the operation length of the starter cable can be substantially reduced to generate enough initial momentum to start up the engine. In other words, the space of the power generator can be further reduced to start the engine.

Another object of the present invention is to provide a power generator with a hand-free starter, wherein the foot pedal is positioned for the user to step thereon without bending his/her body, so as to prevent the user form being hurt during the stepping action.

Another object of the present invention is to provide a power generator with a hand-free starter, which does not require altering the original structural design of the power generator, so as to minimize the manufacturing cost of the power generator incorporating with the hand-free starter.

Another object of the present invention is to provide a power generator with a hand-free starter, wherein the hand-free starter is adapted to install into any existing power generator having the starter cable.

Another object of the present invention is to provide a power generator with a hand-free starter, wherein no expensive or complicated structure is required to employ in the present invention in order to achieve the above mentioned objects. Therefore, the present invention successfully provides an economic and efficient solution for providing a hand-free starter for the power generator in a hand-free manner.

Accordingly, in order to accomplish the above objects, the present invention provides a power generator, comprising:

a supporting frame;

a generator supported by the supporting frame;

an engine mechanism which comprises an engine driving the generator and a recoil starter for starting the engine, wherein the recoil starter comprises a starter cable having a pulling end retractably pulled to activate the engine; and a hand-free starter arrangement, which comprises:

a foot pedal, which is adapted for a user stepping thereon to apply a downward stepping force, movably supported by the supporting frame; and a transmission unit, which is supported at the supporting frame, coupling the pulling end of the starter cable with the foot pedal to transmit the downward stepping force of the foot pedal to a pulling force of the starter cable, wherein a downward displacement of the foot pedal is corresponding to an operation length of the starter cable to start the engine such that when the foot pedal is depressed, the starter cable is pulled with the operation length to start the engine in a hand-free manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
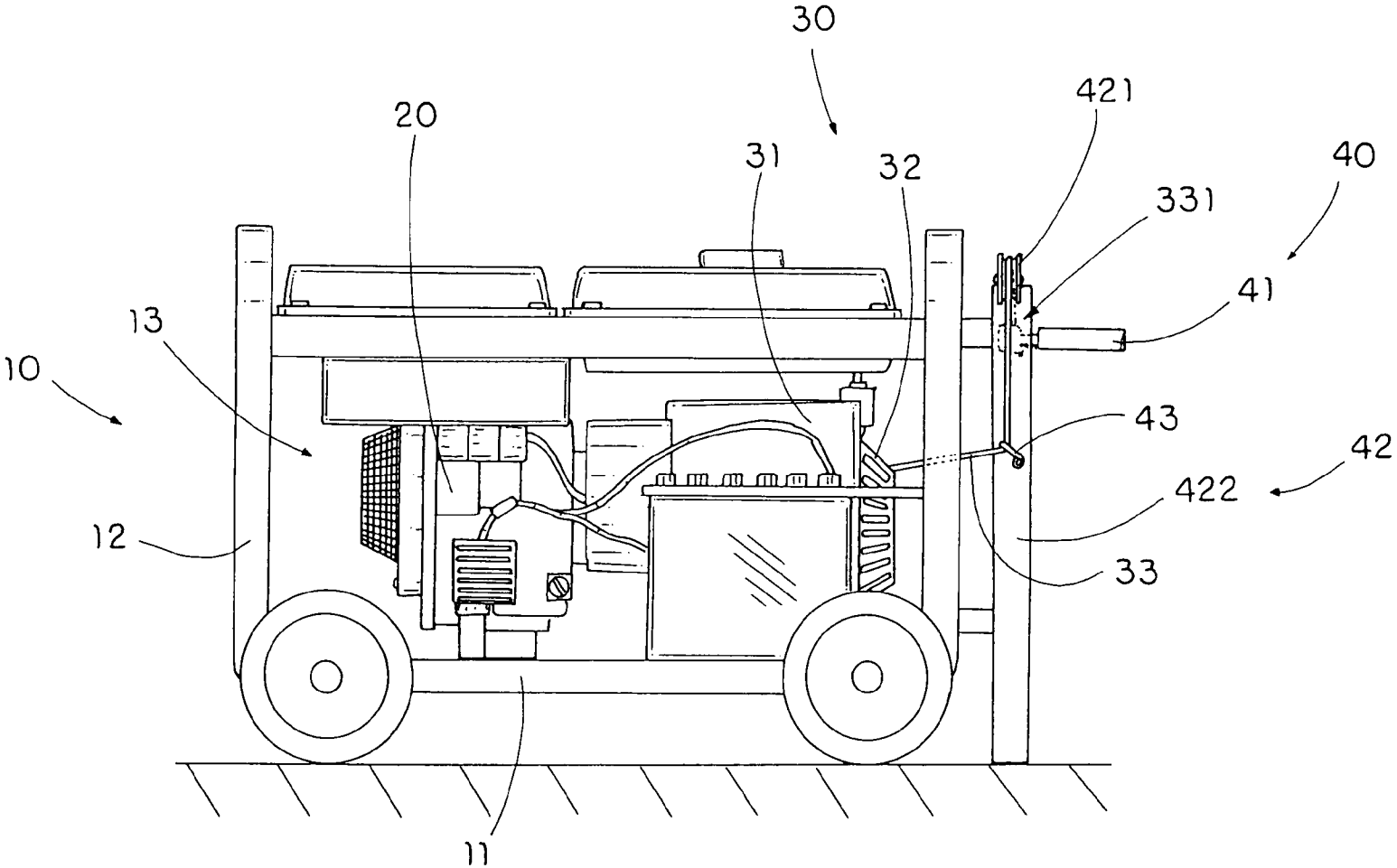
FIG. 1 is a side view of a power generator with a hand-free starter according to a first preferred embodiment of the present invention.

Referring to FIG. 1 of the drawings, a power generator with a hand-free starter according to a first embodiment of the present invention is illustrated, wherein the power generator comprises a supporting frame 10, a generator 20 supported by the supporting frame 10, and an engine mechanism 30.

Accordingly, the supporting frame 10 comprises a base support 11 and a plurality of supporting posts 12 to define a supporting cavity 13 to receive the generator 20 and the engine mechanism 30 therein.

The generator 20 can be an AC generator supported adjacent to the engine mechanism 30 wherein the engine mechanism 30 is operatively connected to the generator such that when the engine mechanism 30 is activated, the generator 20 generates an AC (alternating current) power. It is worth to mention that an AC to DC converter can be operatively coupled with the generator to convert the AC power into a DC (direct currently) power. Alternatively, the generator 20 can be a DC generator to generate the DC power when the engine mechanism 30 is activated.

The engine mechanism 30 comprises an engine 31 driving the generator 20 and a recoil starter 32 for starting the engine 31, wherein the recoil starter 32 comprises a starter cable 33 having a pulling end 331 retractably pulled to activate the engine 31. Accordingly, the recoil starter 32 has a cable opening 322 for the pulling end 331 of the starter cable 33 extending out of the engine 31. In addition, the cable opening 322 is generally facing upward such that the user is able to easily pull the starter cable upwardly to start the engine.

According to the preferred embodiment, the engine 31 can be an internal combustion engine having a fuel supply system, wherein a fuel tank is supported in the supporting cavity 13 of the supporting frame for containing an engine fuel to supply the engine 31 through the fuel supply system. It is worth to mention that different kinds of engine can be incorporated to drive the generator 20 on condition that the engine 31 is started by the recoil starter 32.

Accordingly, the starter cable 33 has an operation length that when the starter cable 33 is pulled, a predetermined initial momentum is generated to start the engine 31.

Figure 2:
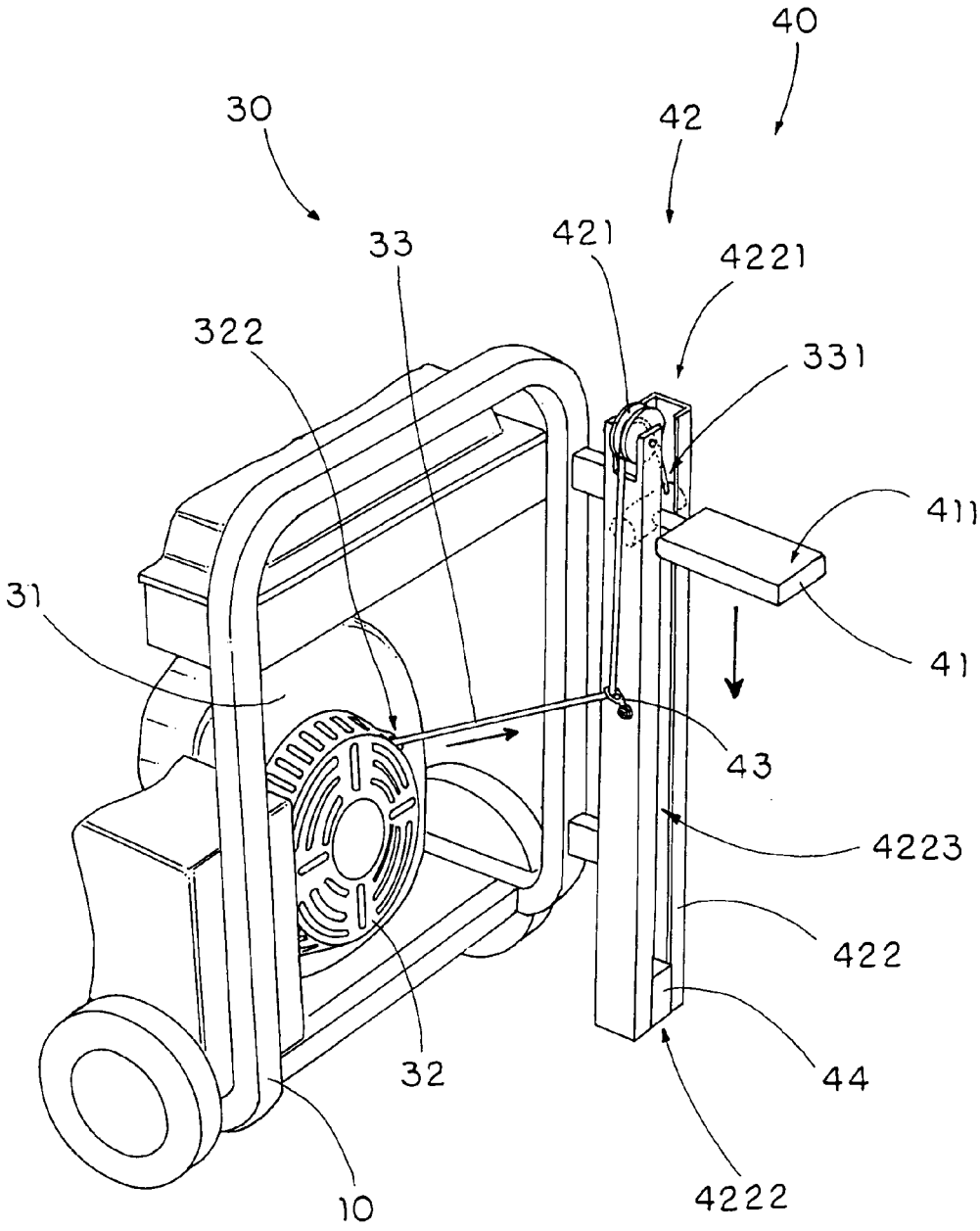
FIG. 2 is a perspective view of the hand-free starter of the power generator according to the above first preferred embodiment of the present invention.

According to the preferred embodiment, the power generator further comprises a hand-free starter arrangement 40 which comprises a foot pedal 41 and a transmission unit 42, as shown in FIG. 2.

The foot pedal 41 is movably supported by the supporting frame 10 for the user stepping on the foot pedal 41 to apply a downward stepping force. Accordingly, the foot pedal 41 has a stepping surface 411 allowing a foot of the user to step thereon.

The transmission unit 42, which is supported at the supporting frame 10, is coupling the pulling end 331 of the starter cable 33 with the foot pedal 41 to transmit the downward stepping force of the foot pedal 41 to a pulling force of the starter cable 33. The downward displacement of the foot pedal 41 is corresponding to an operation length of the starter cable 33 to start the engine 31 such that when the foot pedal 41 is depressed, the starter cable 33 is pulled with the operation length to start the engine 31 in a hand-free manner. In other words, the user is able to use his/her foot to easily start the engine 31 because the foot of the user is more powerful than the arm of the user.

As shown in FIG. 2, the transmission unit 42 comprises a cable pulley 421 supported at the supporting frame 10 at a position that the pulling end 331 of the starter cable 33 is slidably extended to the foot pedal 41 through the cable pulley 421 such that the cable pulley 421 detours a pulling direction of the starter cable 33 to a downward direction of the foot pedal 41.

The cable pulley 421 has a concave surface for the starter cable 33 sliding thereon in a smooth moving manner so as to retain the starter cable 33 in position. The cable pulley 421 is supported at the supporting frame 10 at a position above the cable opening 332 to transmit the pulling force in an upward direction into the downward stepping force via the foot pedal 41. Accordingly, the user is able to generate the powerful stepping force by his/her foot instead of the upward pulling force by his/her arm. Therefore, once the starter cable 33 is slidably engaged with the cable pulley 421, the sliding direction can be adjusted from the upward pulling force to the downward stepping force. In other words, the user is able to generate a powerful downward force, which is approximately 50 pound force, to depress the foot pedal 41 so as to start the engine 31. It is worth to mention that by using the weight of the user, the 50 pound force can be relatively easily to be generated by the foot of the user to depress the foot pedal 41.

As shown in FIG. 2, the foot pedal 41 is vertically moved with respect to the supporting frame 10. The transmission unit 42 further comprises a sliding frame 422 attached to the supporting frame 10 to guide the foot pedal 41 in a vertically sliding manner. The sliding frame 422 has a top guiding end 4221 coupling with the cable pulley 421, a bottom stopper end 4222, an elongated sliding track 4223 which is formed between the guiding end 4221 and the stopper end 4222 and is slidably engaging with the foot pedal 421 such that when the foot pedal 421 is downwardly depressed along the sliding track 4223 from the guiding end 4221 to the stopper end 4222 as the downward displacement of the foot pedal 421, the starter cable 33 is pulled to start the engine 31.

The sliding frame 422 generally has a U-shaped cross section to define the sliding track 4223 therein wherein a length of the sliding track 4223, which is the distance between the guiding end 4221 to the stopper end 4222, is corresponding to the operation length of the starter cable 33 such that when the foot pedal 41 is depressed, the starter cable 33 is pulled long enough with the operation length to generate the initial momentum to start the engine 31. In other words, the downward displacement of the foot pedal 421 is corresponding to the length of the sliding track 4223 for the foot pedal 421 vertically traveling therealong.

Furthermore, the foot pedal 41 is longitudinally positioned for the user stepping thereon without bending his/her body to prevent the user form being hurt during the stepping action. The foot pedal 41 is supported approximately 1 foot from the ground such that the user is able to easily step on the foot pedal 41.

In order to hold the starter cable 33 in a corrected direction, the transmission unit 42 further comprises a cable holder 43 mounted to the sliding frame 422 at a position below the cable pulley 421 wherein the pulling end 331 of the starter cable 33 is slidably passing through the cable holder 43 to slidably engage with the cable pulley 421. As shown in FIG. 2, the starter cable 33 is inclinedly extended out of the engine 31 through the cable opening 322. In order to effectively transmit the downward stepping force to the pulling force of the starter cable 33, the portion of the starter cable 33 between the cable holder 43 and the cable pulley 421 should be extended in a vertical manner. Therefore, when the pulling end 331 of the starter cable 33 is slidably passing through the cable holder 43, the portion of the starter cable 33 is changed from the inclined direction to the vertical direction.

A shock absorber 44 is mounted at the stopper end 4222 of the sliding frame 422 to absorb the impact force of the foot pedal 41 when the foot pedal 41 is slid to the stopper end 4222 of the sliding frame 422. Accordingly, the shock absorber 44 is preferably made of rubber attached to the stopper end 4222 of the sliding frame 422 not only to stop the further downward sliding movement of the foot pedal 41 along the sliding track 4223 but also to absorb the impact force of the foot pedal 41 when the foot pedal 41 is slid in a speedy manner.

As shown in FIG. 2, the foot pedal 41 has an inner end pivotally coupling with the sliding frame 442 such that when the foot pedal 41 is not in use, the foot pedal 41 is adapted to be upwardly and pivotally folded towards the sliding track 4223 for storage. For starting the engine 31, the user is able to downwardly and pivotally fold the foot pedal 41 such that the foot pedal 41 is supported at a horizontal manner for the user stepping thereon.

In order to start the engine 31, the user simply applies the downward stepping force on the foot pedal 41 to depress the foot pedal 41. The transmission unit 42 is adapted to transmit the downward stepping force to the pulling force to pull the starter cable 33 so as to generate the initial momentum for the engine 31. It is worth to mention the user is able to generate a powerful stepping force by his/her foot in comparison with a pulling force by his/her arm. Therefore, the user will not easily getting tried even through the user pulls the starter cable 33 by his/her foot. Once the foot pedal 41 is slid towards the stopper end 4222 of the sliding frame 422, the recoil starter 32 will retractably pull the starter cable 33 back to its original state. Therefore, the foot pedal 41 is automatically pulled back to the guiding end 4221 of the sliding frame 422 via the retracting starter cable 33 through the cable pulley 421.

Figure 3:
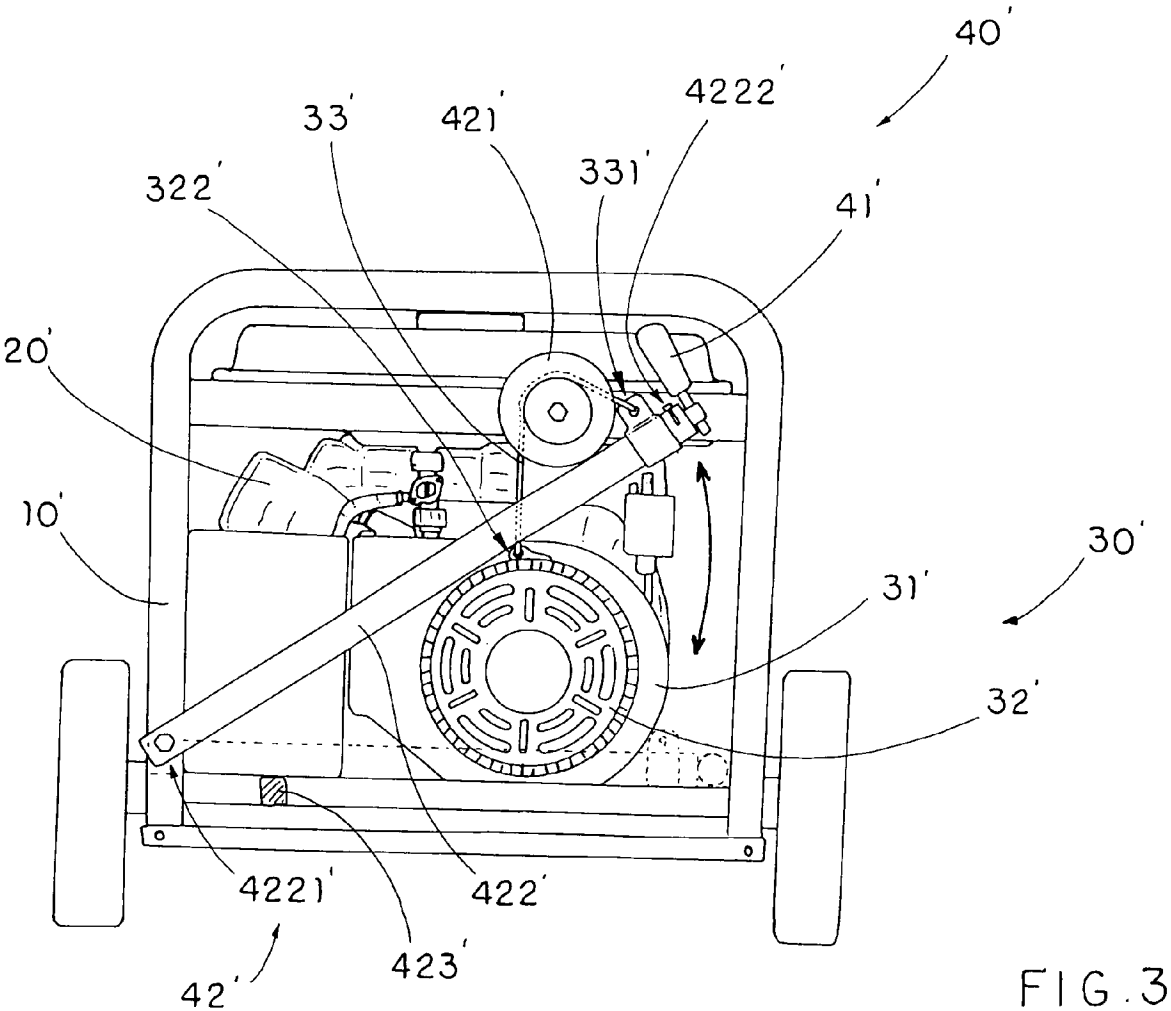
FIG. 3 is a side view of a hand-free starter of a power generator according to a second preferred embodiment of the present invention.

As shown FIG. 3, a power generator of a second embodiment illustrates an alternative mode of the first embodiment of the present invention, wherein the power generator of the second embodiment has the same component, such as the supporting frame 10', the generator 10' and the engine mechanism 30' of the first embodiment. The difference between the first and second embodiments is the hand-free starter arrangement 40'. As shown in FIG. 3, the hand-free starter arrangement 40' which comprises a foot pedal 41' and a transmission unit 42'.

The foot pedal 41' is movably supported by the supporting frame 10' for the user stepping on the foot pedal 41' to apply a downward stepping force. Accordingly, the foot pedal 41' has a stepping surface 411' allowing a foot of the user to step thereon.

The transmission unit 42', which is supported at the supporting frame 10', is coupling the pulling end 331' of the starter cable 33' with the foot pedal 41' to transmit the downward stepping force of the foot pedal 41' to a pulling force of the starter cable 33'. The downward displacement of the foot pedal 41' is corresponding to an operation length of the starter cable 33' to start the engine 31' such that when the foot pedal 41' is depressed, the starter cable 33' is pulled with the operation length to start the engine 31' in a hand-free manner. In other words, the user is able to use his/her foot to easily start the engine 31' because the foot of the user is more powerful than the arm of the user.

As shown in FIG. 3, the transmission unit 42' comprises a cable pulley 421' supported at the supporting frame 10' at a position that the pulling end 331' of the starter cable 33' is slidably extended to the foot pedal 41' through the cable pulley 421' such that the cable pulley 421' detours a pulling direction of the starter cable 33' to a downward direction of the foot pedal 41'.

The cable pulley 421' has a concave surface for the starter cable 33' sliding thereon in a smooth moving manner so as to retain the starter cable 33' in position. The cable pulley 421' is supported at the supporting frame 10' at a position above the cable opening 332' to transmit the pulling force in an upward direction into the downward stepping force via the foot pedal 41'.

As shown in FIG. 3, the foot pedal 41' is downwardly and pivotally moved with respect to the supporting frame 10'. The transmission unit 42' further comprises a pivot arm 422' having a pivot end 4221' pivotally coupling at the supporting frame 10' and a controlled end 4222' coupling with the foot pedal 41', wherein the cable pulley 421' supported at the supporting frame 10' at a position between the pivot end 4221' of the pivot arm 421' and the controlled end 4222' thereof to slidably engage with the starter cable 33', such that when the foot pedal 41' is downwardly depressed at the controlled end 4222' of the pivot arm 422' to pivotally and downwardly move the pivot arm 421', the starter cable 33' is pulled via the cable pulley 421' to start the engine 31'.

As shown in FIG. 3, the pivot end 4221' of the pivot arm 422' is pivotally connected to a bottom portion of the supporting frame 10' at a position below the cable opening 332', wherein the controlled end 4222' of the pivot arm 422' is inclinedly and upwardly extended at a position above the cable opening 332', such that when the controlled end 4222' of the pivot arm 422' is downwardly and pivotally depressed via the foot pedal 41', the starter cable 33' is upwardly pulled to start the engine 31'.

The foot pedal 41' has an inner end pivotally coupling with the controlled end 4222' of the pivot arm 422' such that when the foot pedal 41' is not in use, the foot pedal 41' is adapted to be upwardly and pivotally folded towards the supporting frame 10' for storage. For starting the engine 31', the user is able to downwardly and pivotally fold the foot pedal 41' such that the foot pedal 41' is supported at a horizontal manner for the user stepping thereon.

The transmission unit 42' further comprises an arm stopper 423' affixed to the bottom portion of the supporting frame 10' at a position that when the pivot arm 422' is pivotally and downwardly depressed, the pivot arm 422' is blocked at the arm stopper 432' to block a further downward movement of the pivot arm 422'.

In order to start the engine 31', the user simply applies the downward stepping force on the foot pedal 41' to depress the foot pedal 41'. The transmission unit 42' is adapted to transmit the downward stepping force to the pulling force through the cable pulley 421' and the pivot arm 422' to pull the starter cable 33' so as to generate the initial momentum for the engine 31'.

Figure 4:
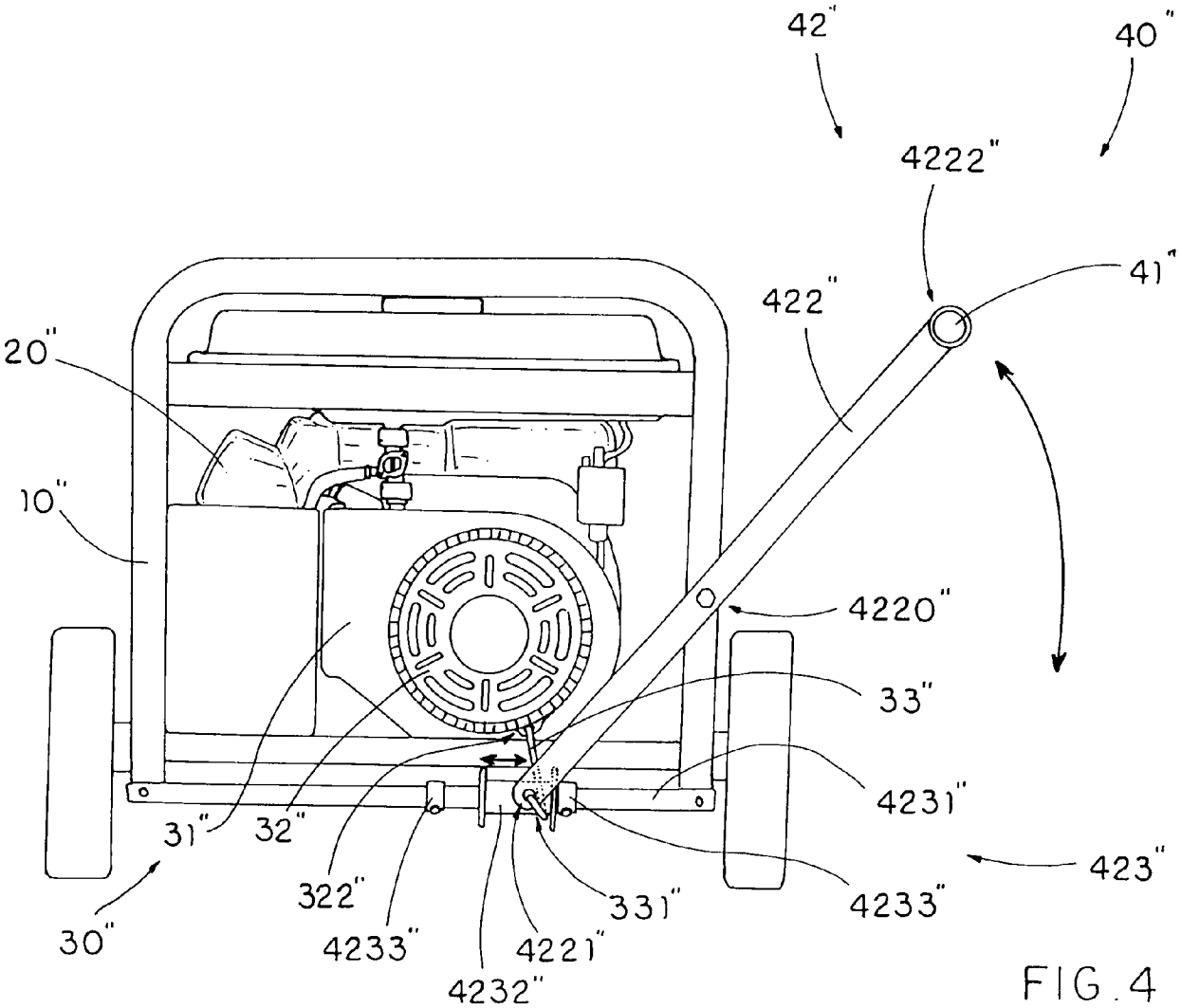
FIG. 4 is a side view of a hand-free starter of a power generator according to a third preferred embodiment of the present invention.

As shown FIG. 4, a power generator of a third embodiment illustrates an alternative mode of the second embodiment of the present invention, wherein the power generator of the third embodiment has the same component, such as the supporting frame 10", the generator 10" and the engine mechanism 30" of the second embodiment. The difference between the second and third embodiments is the hand-free starter arrangement 40". As shown in FIG. 4, the hand-free starter arrangement 40' which comprises a foot pedal 41" and a transmission unit 42".

The foot pedal 41" is movably supported by the supporting frame 10" for the user stepping on the foot pedal 41" to apply a downward stepping force. Accordingly, the foot pedal 41" has a stepping surface 411" allowing a foot of the user to step thereon.

The transmission unit 42", which is supported at the supporting frame 10", is coupling the pulling end 331" of the starter cable 33" with the foot pedal 41" to transmit the downward stepping force of the foot pedal 41" to a pulling force of the starter cable 33". The downward displacement of the foot pedal 41" is corresponding to an operation length of the starter cable 33" to start the engine 31" such that when the foot pedal 41" is depressed, the starter cable 33" is pulled with the operation length to start the engine 31" in a hand-free manner. In other words, the user is able to use his/her foot to easily start the engine 31" because the foot of the user is more powerful than the arm of the user.

As shown in FIG. 4, the transmission unit 42" comprises a pivot arm 422" having a driving end 4221" coupling with the pulling end 331" of the starter cable 33", a controlled end 4222" coupling with the foot pedal 41", and a pivot point 4220" defining between the driving end 4221" and the controlled end 4222" and pivotally connecting to the supporting frame 10" such that when the foot pedal 41" is downwardly depressed at the controlled end 4222" of the pivot arm 422", the driving end 4221" of the pivot arm 422" is pivotally lifted up to pull the starter cable 33" so as to start the engine 31".

Accordingly, the recoil starter 32" has a cable opening 332" for the pulling end 331" of the starter cable 33" extending out of the engine 31". The pivot point 4220" is mounted at the supporting frame 10" at a position above the cable opening 332". The driving end 4221" of the pivot arm 422" is positioned below the cable opening 332" while the controlled end 4222" of the pivot arm 422" is inclinedly and upwardly extended at a position above the cable opening 332". Therefore, when the controlled end 4222" of the pivot arm 422" is pivotally and downwardly depressed via the foot pedal 41", the driving end 4221" of the pivot arm 422" is pivotally lifted up to upwardly pull the starter cable 33".

The transmission unit 42" further comprises a sliding guider 423" longitudinally supported by the supporting frame 10" at a position below the cable opening 332" of the recoil starter 32" such that the pulling end 331" of the starter cable 33" is extended under the sliding guider 423" to couple with the driving end 4221" of the pivot arm 422" so as to substantially reduce the downward displacement of the foot pedal 41" to start the engine 31".

As shown in FIG. 4, the sliding guider 423" comprises a guiding arm 4231" longitudinally supported by the supporting frame 10" and a cable guider 4232" slidably and rotatably mounted along the guiding arm 4231" to engage with the starter cable 33" such that when the driving end 4221" of the pivot arm 422" is pivotally lifted up to pull the starter cable 33", the cable guider 4232" is slid along the guiding arm 4231" to self-adjust a position of the starter cable 33" with respect to the guiding arm 4231".

The cable guider 4232" has a tubular shape coaxially and slidably mounted along the guiding arm 4231". Since the driving end 4221" of the pivot arm 422" travels in an arc path when controlled end 4222" of the pivot arm 422" is depressed downwardly and pivotally. Therefore, the cable guider 4323" is adapted to guide the longitudinal movement of the starter cable 33" along the guiding arm 4231" to allow the starter cable 33" being pulled smoothly.

The sliding guider 423" further comprises two spaced apart sliding stoppers 4233" mounted along the guiding arm 4231" to retain the cable guider 4232" between the two sliding stoppers 4233" so as to limit the cable guider 4232" sliding along the guiding arm 4231" between the sliding stoppers 4233". In other words, at the normal position, the cable guider 4232" is positioned adjacent to one of the sliding stoppers 4233" when the controlled end 4222" of the pivot arm 422" is not depressed. The cable guider 4232" is slid towards another sliding stopper 4233" when the controlled end 4222" of the pivot arm 422" is downwardly and pivotally depressed.

In order to start the engine 31", the user simply applies the downward stepping force on the foot pedal 41" to depress the foot pedal 41". The transmission unit 42" is adapted to transmit the downward stepping force to the pulling force through the pivot arm 422" to pull the starter cable 33" so as to generate the initial momentum for the engine 31".

It is worth to mention that since the starter cable 33" is extended underneath the sliding guider 423" to couple with the driving end 4221" of the pivot arm 422", the downward displacement of the foot pedal 41" can be further reduced for starting the engine 31". Accordingly, such configuration is useful to incorporate with a compact engine-type apparatus such as a power lawn equipment as shown in FIG. 5.

Figure 5:
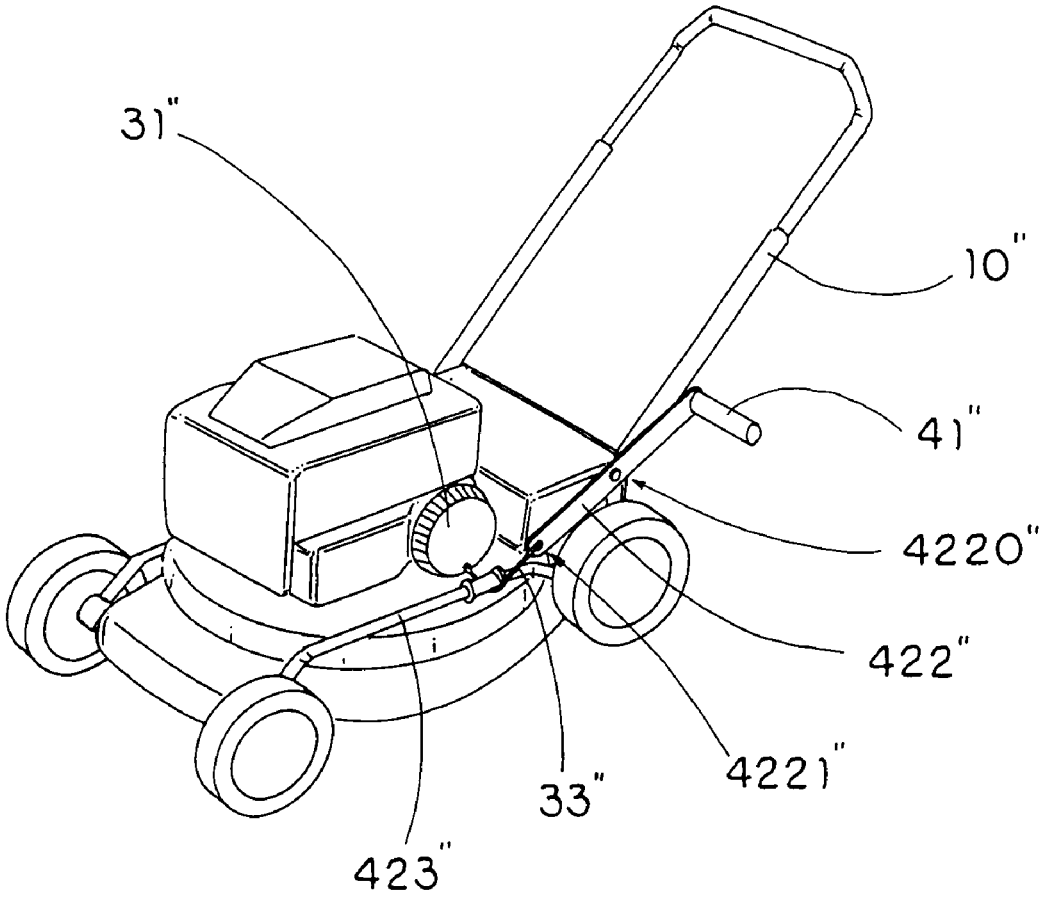
FIG. 5 illustrates the hand-free starter incorporating with a power generator of a power lawn machine according to the above third preferred embodiment of the present invention.

As shown in FIG. 5, the pivot point 4220" of the pivot arm 422" is pivotally connected to the handle of the power lawn equipment as the supporting frame 10" wherein the starter cable 33" is extended underneath the sliding guider 423" to couple with the pivot arm 422" such that the user is able to start the engine 31" of the power lawn equipment by depressing the foot pedal 41".

According to the present invention, the first to third embodiments illustrate the hand-free starter incorporating with the power generator to start the power generator without using the hand of the user to pull the starter cable 33, 33', 33". The user is able to use his/her foot with powerful stepping force to depress the foot pedal 41, 41', 41".

The hand-free starter of the present invention can also incorporate with the existing power generator having the starter cable 33, 33', 33" by coupling the hand-free starter to the supporting frame 10, 10', 10". In addition, the hand-free starter can further comprises an add-on supplement frame to support the hand-free starter arrangement 40, 40', 40" such that when the supplement frame is mounted to the supporting frame 10, 10', 10", the pulling end 331, 331', 331" of the starter cable 33, 33', 33" can couple with the hand-free starter arrangement 40, 40', 40" to start the engine 31, 31', 31" in a hand-free manner. Alternatively, the supporting frame 10, 10', 10" can be embodied as an outer casing of the engine 31, 31', 31" such that the hand-free starter arrangement 40, 40', 40" is directly supported at the outer casing of the engine 31, 31', 31" to start the engine 31, 31', 31" in a hand-free manner. In other words, the power generator does not require any supporting frame 10, 10', 10" to support the hand-free starter arrangement 40, 40', 40" if the outer casing of the engine 31, 31', 31" is rigid and relatively large. Furthermore, the above first to third embodiments illustrates the hand-free starter incorporating with the power generator including the generator 20, 20', 20" and the engine mechanism 30, 30', 30". In fact, the hand-free starter of the present invention can only incorporate with any engine mechanism having a starter cable for start up such that no generator is included.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A power generator, comprising:

a supporting frame;

a generator supported by said supporting frame;

an engine mechanism which comprises an engine driving said generator and a recoil starter for starting said engine, wherein said recoil starter comprises a starter cable having a pulling end retractably pulled to activate said engine; and a hand-free starter arrangement, which comprises:

a foot pedal, which is adapted for a user stepping thereon to apply a downward stepping force, movably supported by said supporting frame; and a transmission unit, which is supported at said supporting frame, coupling said pulling end of said starter cable with said foot pedal to transmit said downward stepping force of said foot pedal to a pulling force of said starter cable, wherein a downward displacement of said foot pedal is corresponding to an operation length of said starter cable to start said engine such that when said foot pedal is depressed, said starter cable is pulled with said operation length to start said engine in a hand-free manner;

wherein said transmission unit comprises a cable pulley supported at said supporting frame at a position that said pulling end of said starter cable is slidably extended to said foot pedal through said cable pulley such that said cable pulley detours a pulling direction of said starter cable to a downward direction of said foot pedal, wherein said transmission unit further comprises a sliding frame attached to said supporting frame to guide said foot pedal in a vertically sliding manner, wherein said sliding frame has a top guiding end coupling with said cable pulley, a bottom stopper end, an elongated sliding track which is formed between said guiding end and said stopper end and is slidably engaging with said foot pedal such that when said foot pedal is downwardly depressed along said sliding track from said guiding end to said stopper end as said downward displacement of said foot pedal, said starter cable is pulled to start said engine, wherein said transmission unit further comprises a cable holder mounted to said sliding frame at a position below said cable pulley, wherein said pulling end of said starter cable is slidably passing through said cable holder to slidably engage with said cable pulley such that a portion of said starter cable between said cable holder and said cable pulley is extended in a vertical manner.

2. A power generator, comprising:

a supporting frame;

a generator supported by said supporting frame;

an engine mechanism which comprises an engine driving said generator and a recoil starter for starting said engine, wherein said recoil starter comprises a starter cable having a pulling end retractably culled to activate said engine; and a hand-free starter arrangement, which comprises:

a foot pedal, which is adapted for a user stepping thereon to apply a downward stepping force, movably supported by said supporting frame; and a transmission unit, which is supported at said supporting frame, coupling said pulling end of said starter cable with said foot pedal to transmit said downward stepping force of said foot pedal to a pulling force of said starter cable, wherein a downward displacement of said foot pedal is corresponding to an operation length of said starter cable to start said engine such that when said foot pedal is depressed, said starter cable is pulled with said operation length to start said engine in a hand-free manner, wherein said transmission unit comprises a cable pulley supported at said supporting frame at a position that said pulling end of said starter cable is slidably extended to said foot pedal through said cable pulley such that said cable pulley detours a pulling direction of said starter cable to a downward direction of said foot pedal, wherein said recoil starter has a cable opening for said pulling end of said starter cable extending out of said engine, wherein said cable pulley is supported at said supporting frame at a position above said cable opening to transmit said pulling force in an upward direction into said downward stepping force via said foot pedal, wherein said transmission unit further comprises a sliding frame attached to said supporting frame to guide said foot pedal in a vertically sliding manner, wherein said sliding frame has a top guiding end coupling with said cable pulley, a bottom stopper end, an elongated sliding track which is formed between said guiding end and said stopper end and is slidably engaging with said foot pedal such that when said foot pedal is downwardly depressed along said sliding track from said guiding end to said stopper end as said downward displacement of said foot pedal, said starter cable is pulled to start said engine, wherein said transmission unit further comprises a cable holder mounted to said sliding frame at a position below said cable pulley, wherein said pulling end of said starter cable is slidably passing through said cable holder to slidably engage with said cable pulley such that a portion of said starter cable between said cable holder and said cable pulley is extended in a vertical manner.

3. The power generator, as recited in claim 2, wherein said transmission unit further comprises a shock absorber is mounted at said stopper end of said sliding frame for absorbing an impact force of said foot pedal when said foot pedal is slid to said stopper end of said sliding frame.

* * * * *